US006814188B1

(12) United States Patent
Heckert

(10) Patent No.: US 6,814,188 B1
(45) Date of Patent: Nov. 9, 2004

(54) SCISSORS-TYPE LIFT TABLE

(75) Inventor: Gerold Heckert, Sachsenheim (DE)

(73) Assignee: Heckert GmbH, Vaihingen (DE)

( * ) Notice: Subject to any disclaimer, the term of this patent is extended or adjusted under 35 U.S.C. 154(b) by 0 days.

(21) Appl. No.: 10/031,861

(22) PCT Filed: Apr. 12, 2000

(86) PCT No.: PCT/EP00/03242

§ 371 (c)(1),
(2), (4) Date: Nov. 7, 2001

(87) PCT Pub. No.: WO00/68597

PCT Pub. Date: Nov. 16, 2000

(30) Foreign Application Priority Data

May 8, 1999 (DE) ..... 199 21 435
Jan. 19, 2000 (DE) ..... 100 01 910

(51) Int. Cl.[7] ..... B66F 3/22
(52) U.S. Cl. ..... 187/269; 187/211; 254/111
(58) Field of Search ..... 187/211, 262, 187/261, 269; 254/122

(56) References Cited

U.S. PATENT DOCUMENTS 1,991,255 A * 2/1935 Martin ..... 187/211
2,862,689 A * 12/1958 Dalrymple et al. ..... 254/122 X
3,556,481 A * 1/1971 Mueller et al. ..... 254/122
3,785,462 A 1/1974 Coad et al.
4,504,041 A * 3/1985 Raz ..... 254/122 X
4,534,544 A * 8/1985 Heide ..... 254/122 X
4,585,212 A * 4/1986 Yanker ..... 254/122
5,722,513 A * 3/1998 Rowan et al. ..... 187/269
6,082,433 A * 7/2000 Vafaie et al. ..... 160/310

FOREIGN PATENT DOCUMENTS

DE 604 156 10/1934
DE 3144 621 9/1982
DE 19648607 A1 * 5/1998

* cited by examiner

*Primary Examiner*—Eileen D. Lillis
*Assistant Examiner*—Thuy V. Tran
(74) *Attorney, Agent, or Firm*—Jansson, Shupe & Munger, Ltd.

(57) ABSTRACT

The invention relates to a scissors-like lifting device having a pair of scissors that are arranged between a carrier or support unit and a base unit. Each pair of scissors is provided with two arms which can be pivoted about corresponding axles. The scissors-like lifting device is provided with a lifting truck that can be moved by means of a drive in order to open and close the scissors. The inventive configuration efficiently controls the lifting movement. The band-like traction mechanism can be wound-up on the drum by means of the drive in order to pull the lifting truck towards the scissors axle so that the scissors are opened. The band-like traction device can be unwound from the drum so that the truck is moved away from the scissors axle by the force of gravity on the support and arms thereby closing the scissors.

19 Claims, 1 Drawing Sheet

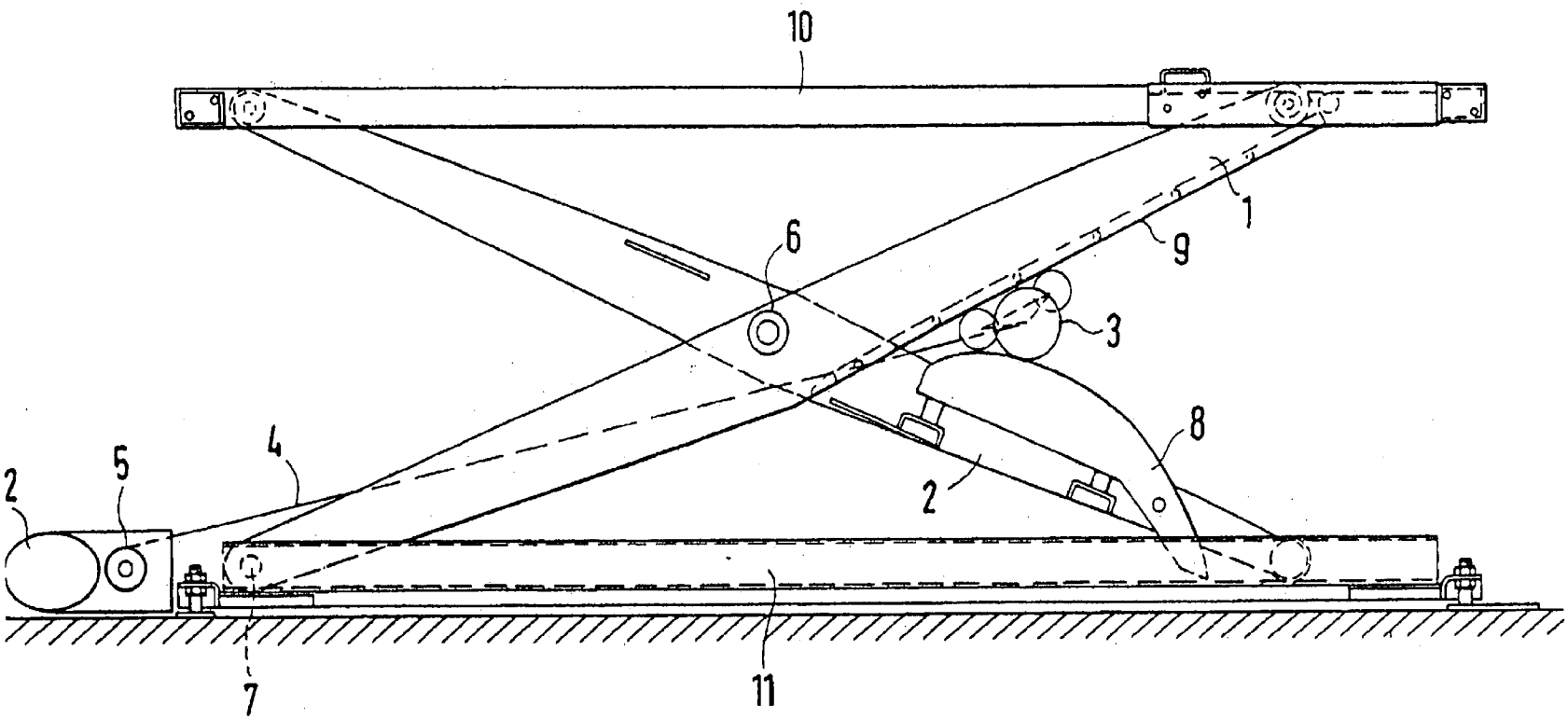
1
9
3
8
2
10
6
11
4
7
5
2

SCISSORS-TYPE LIFT TABLE

RELATED APPLICATION AND CLAIM OF PRIORITY

This application is a continuation of PCT Application No. PCT/EPO/03242 having an international filing date of Apr. 12, 2000, which designates at least one country in addition to the United States and which claims priority from German Application Nos. 199 21 435.2 filed May 8, 1999 and 100 01 910.2 filed Jan. 19, 2000. For priority purposes, this application claims the benefit of 35 USC 371 and/or 35 USC 120.

FIELD OF INVENTION

The invention pertains to a scissors lifting table device with at least one pair of scissors arranged between a carrier unit and a base unit. The scissors comprise two arms that can be pivoted relative to one another about a scissors axle or axis. The lifting device further includes a lifting truck which can be moved in opposite directions by means of a drive in order to open and close the scissors. The drive powers a drum that is aligned parallel to the scissors axis and serves to move at least one band that extends around the drum and is coupled to the lifting truck at one end. The band is wound onto the drum by means of the drive in order to open the scissors by pulling the lifting truck toward the scissors axle. The band is unwound from the drum in order to close the scissors through movement of the lifting truck in the opposite direction, i.e., away from the scissors axle.

BACKGROUND OF THE INVENTION

A scissors lifting table device is described in DE 604 156 C. In this known scissors lifting table, lifting rollers that extend parallel to a scissors axis are arranged on both sides of the scissors axis between the scissors arms. These lifting rollers can be moved toward one another by means of a cable arrangement in the form of a block and pulley so as to lift the carrying device of the scissors lifting table. The lifting rollers can be moved apart from one another so as to lower the carrying device. For this purpose, one end of the cable is connected to a take-up drum that is powered by means of a drive. The cable extends over several guide elements before it reaches the take-up drum.

In another scissors lifting table that is described in U.S. Pat. No. 3,785,462, one end of a traction cable is fixed to and wound up at a lower shaft. The traction cable extends around several other deflection rollers and a roller-shaped lifting element that can be moved between the scissors arms. The other end of the traction cable is fixed to the upper section of the lifting table. When the cable is wound/unwound onto/from the lower shaft that is powered by means of a drive and a chain, the lifting element is respectively moved toward or away from the scissors axis such that the carrying device of the lifting table is lifted or lowered.

Another scissors lifting table for lifting and lowering loads is described in DE 90 05 566 U1. In this known scissors lifting table, a platform that accommodates the load is respectively lifted and lowered by opening and closing the scissors arms of two lateral scissors arranged in parallel. The scissors are opened and closed by means of a lifting sled or lifting truck that is moved backward and forward between longitudinal side braces of a base unit. On its upper side, the lifting truck is provided with obliquely extending lifting cams which cooperate with rollers for lifting and lowering the platform. The lifting cams are positioned near the scissors axis. The lifting sled is powered by means of a drive via a threaded spindle. Such a spindle is a precision part and is usually supported in a ball bearing inside a spindle nut. A spindle drive of this type is relatively costly and is so sensitive to transverse forces and vibrations that the smooth operation of the spindle drive may be impaired and the spindle drive damaged by such forces.

A scissors lifting table with a hydraulic actuator is described in DE 44 13 527 A1 and in DE 83 29 409 U1. A hydraulic actuator of this type typically causes jerks at the beginning and end of the opening and closing movements, and may also cause undesirable oily deposits.

SUMMARY OF THE INVENTION

The objective of this invention is to provide a scissors lifting table of the initially described type that ensures a reliable and controlled lifting movement.

This objective is attained through the inventive arrangement of a carrier unit and base unit interconnected by at least one pair of scissors arms, a drum for winding traction means to provide a force, and a lifting truck positioned between the scissors arms so that it can be pulled toward the scissors axis by the traction means. It is preferred that only one lifting truck is provided and that the traction means is a band that extends directly from the drum to the lifting truck.

This construction allows the beginning and the end of the lifting and lowering movement to be controlled in a superior fashion while simultaneously achieving a more robust and less expensive design. In addition, if at least two band-like traction means are utilized in a parallel fashion, the lifting table can continue to operate when one of the traction means is damaged.

The lifting movement can be controlled to operate in a desired fashion by the use of lifting cams which guide the lifting truck and are arranged on the lower arm sections of one pair of parallel arms, on the upper arm sections of the other pair of parallel arms, or in both positions. For example, through use of a specific design of lifting cams a constant lifting load can be achieved wherein the tensile stress in the band-like traction means remains constant in all lifting and lowering positions. To provide this capability, the lifting cams may be adjustable or exchangeable in order to vary the movement sequence or the load.

Another advantageous characteristic of the invention is the fact that the drum is arranged at the lower fixed pivot shaft where one of the arms pivotably connects to the base unit. Alternatively, the drum is arranged "outside" the lower fixed pivot shaft so that the lower fixed pivot shaft is between the drum and the lifting truck. If a fixed pivot shaft is used to support the drum, additional bearing elements can be eliminated. Under certain circumstances, the arrangement wherein the drum is positioned outside the pivot shaft may be advantageous with respect to maintenance considerations or guidance of the band.

Superior control of the drive is achieved due to the fact that the drive contains a frequency-controlled electric motor. When utilizing a frequency-controlled electric motor, high lifting speeds and very precise positioning can be achieved.

In order to achieve a controlled lowering movement and to conform with applicable safety standards, it is preferred that the drive be provided with a brake for lowering the carrier unit in a controlled fashion.

In addition, safety is improved due to the fact that a catch device is provided for preventing an uncontrolled lowering movement.

BRIEF DESCRIPTION OF DRAWINGS

The invention is described below with reference to one embodiment that is illustrated in FIG. 1 as a side view.

DETAILED DESCRIPTION OF PREFERRED EMBODIMENTS

FIG. 1 shows a side view of a scissors lifting device that contains a platform or a carrier unit for accommodating a load. The carrier unit contains lateral supports 10, to which the upper ends of two first arms 1 and two second arms 2 are connected. The upper ends of arms 2 are supported on upper fixed pivot shafts and the upper ends of arms 1 are conventionally movably supported in a pivotable fashion in the supports 10 on rollers or pins. The lower ends of both arms 1,2 are supported in lateral rails 11 of a base unit. The lower ends of first arms 1 are supported on lower fixed pivot shafts 7 and the lower ends of second arms 2 are movably supported in a pivotable fashion on the rail 11, for example, on rollers. Each reciprocal pair of arms 1,2 are connected at a scissors axle 6 such that they can be pivoted relative to one another.

In order to lift and lower the carrier unit 10 or to open and close the two reciprocal pairs of scissors formed by the two pairs of arms, a lifting truck 3 is displaceably or movably arranged between the upper portions of arms 1 and the lower portions of arms 2 that face one another. In addition, suitable lifting cams 8,9 for influencing the movement or the load are arranged along the sides of the arms 1,2 which face one another so that the lifting truck 3 is guided on the lifting cams.

The lifting truck 3 is pulled toward the scissors axle 6 by means of one or more traction bands 4 that, if applicable, lie adjacent to one another. Movement of the lifting truck toward the axle 6 lifts the carrier unit and opens the scissors. In the drawing the tension bands 4 are wound up by means of a drum 5. Drum 5 is arranged on the far side of the scissors axle 6 with reference to the lifting truck 3 and is coupled to a drive 12. In order to lower the carrying device and close the scissors, the lifting truck 3 is forced away from the scissors axle 6 due to the dead weight of the arms 1,2 and carrier unit 10 when tension bands 4 are unwound from drum 5. During this lowering action the drive 12 or a corresponding transmission thereof may act as a brake, or a separate brake may be provided.

The drive 12 preferably contains a frequency-controlled electric motor that makes it possible to achieve high lifting speeds and highly precise positioning. The start of the lifting or lowering movement and the movement sequences can be programmed by means of a corresponding control device. In particular, a soft start and stop can be programmed for the initial phase and the final phase of the respective movements.

The drum 5 may be supported on the fixed pivot shaft 7 or separately from it. In order to prevent an uncontrolled lowering movement of the carrier unit 10, it is preferred that a catch device that becomes effective during a fast lowering movement is provided.

What is claimed is:

1. A scissors lifting device comprising:

a base unit;

a carrier unit;

an inner arm having first and second ends, the first end pivotably mounted to the base unit at an inner pivot, the second end slidingly engaging the carrier unit;

an outer arm having first and second ends, the first end slidingly engaging the base unit, the second end pivotably mounted to the carrier unit at an outer pivot, the outer arm pivotably mounted to the inner arm at a scissors axle;

a drive for raising the carrier unit;

a drum parallel to the scissors axle and coupled to the drive to provide rotational movement in both directions;

a lifting truck positioned between the inner and outer arm so that the axle is between the drum and the truck and movement of the truck toward the axle causes the arms to open, and a band having a first end connected to the drum to enable the band to be wound around the drum, and a second end coupled to the lifting truck, the band extending directly from the drum to the lifting truck.

2. The scissors lifting device of claim 1 wherein the inner arm has a upper section located between the axle and the carrier unit and the outer arm has a lower section located between the axle and the base unit, and wherein the lifting truck is guided by a lifting cam that is arranged on one of the upper section and the lower section.

3. The scissors lifting device of claim 1 wherein the the inner arm has a upper section located between the axle and the carrier unit and the outer arm has a lower section located between the axle and the base unit, and wherein the lifting truck is guided by lifting cams that are arranged on both the upper section and the lower section.

4. The lifting device of claim 2 wherein the lifting cam is adjustable and replaceable such that a constant lifting load is achievable through selection and adjustment of a specific lifting cam.

5. The lifting device of claim 1 wherein one arm is pivotably connected to the base unit at a first pivot axis and the drum is positioned at the first pivot axis.

6. The lifting device of claim 1 wherein one arm is pivotably connected to the base unit at a first pivot axis and the drum is positioned such that the distance between the drum and axle is greater than the distance between the first pivot axis and the axle.

7. The lifting device of claim 1 wherein the drive includes a frequency-controlled electric motor.

8. A scissors lifting device including a base unit, a carrier unit, first and second scissor-like arms connected at a scissors axle and pivotably and slideably connected relative to the base unit and carrier unit, the lifting device comprising:

a drive for raising the carrier unit;

a drum parallel to the scissors axle and coupled to the drive to provide rotational movement in both directions, the drum positioned near a pivotable connection between the first arm and the base unit;

a band having first and second ends, the first end connected to the drum to allow the band to wind on the drum when the drum is rotated;

a lifting truck coupled to the second end of the band, the truck positioned between the first and second arms on the side of the axle opposite the drum and movable toward and away from the axle so the movement of the truck toward the axle causes the arms to open; and stress-regulating means for imposing a constant lifting load such that tensile stress in the band remains constant during lifting and lowering, the stress-regulating means connected to at least one of the scissor-like arms.

9. The lifting device of claim 8 wherein the stress-regulating means is adjustable.

10. The lifting device of claim 9 wherein the stress-regulating means is replaceable.

11. The lifting device of claim 10 wherein the stress-regulating means includes a specifically designed lifting cam.

12. The lifting device of claim 8 wherein the stress-regulating means includes two specifically designed lifting cams.

13. The lifting device of claim 8 wherein the band extends directly from the drum to the lifting truck.

14. The lifting device of claim 8 wherein the band includes more than one band, the bands being arranged adjacent to one another, each band having first and second ends, with the first ends connected to the drum and the second ends coupled to the lifting truck.

15. In a scissors lifting device of the type having a base unit, a carrier unit, a pair of scissors having an inner and outer arm pivotably mounted at a scissors axle and connected to the base unit and carrier unit, a drive for opening and closing the scissors, and a drum coupled to the drive for rotational movement, the improvement comprising:

a lifting cam arranged on one of the inner arm and outer arm;

a lifting truck positioned between the inner and outer arm so that the axle is between the drum and truck, the lifting truck being guided by the lifting cam; and a band having a first and second end, the first end connected to the drum to enable the band to be wound around the drum when the drum is rotated, and the second end coupled to the lifting truck, the band extending directly from the drum to the lifting truck;

wherein the lifting cam is adjustable and replaceable such that a constant lifting load is achievable through selection and adjustment of a specific lifting cam and whereby the scissors are opened when the band is wound around the drum and the truck is pulled toward the scissors axle and the scissors are closed when the band is unwound from the drum and the truck is forced away from the axle by the arms.

16. The scissors lifting device of claim 15 wherein the inner arm has an upper section located between the axle and the carrier unit and the outer arm has a lower section located between the axle and the base unit, and wherein the lifting cam is arranged on one of the upper section and the lower section.

17. The scissors lifting device of claim 15 wherein the inner arm has an upper section located between the axle and the carrier unit and the outer arm has a lower section located between the axle and the base unit, and wherein the lifting cam includes first and second lifting cams, the first lifting cam being arranged on the upper section and the second lifting cam being arranged on the lower section.

18. The lifting device of claim 15 wherein the drive includes a frequency-controlled electric motor.

19. The scissors lifting device of claim 15 wherein the band includes more than one band, the bands being arranged adjacent to one another, each band having first and second ends, with the first ends connected to the drum and the second ends coupled to the lifting truck.

* * * * *